US010021479B1

(12) United States Patent
Craig et al.

(10) Patent No.: US 10,021,479 B1
(45) Date of Patent: Jul. 10, 2018

(54) NON-HORIZONTAL MULTIDIRECTIONAL COMPOSITE SPEAKER

(75) Inventors: Paul Michael Craig, Newberg, OR (US); Dennis Alan Colt, Oregon City, OR (US)

(73) Assignees: Paul Michael Craig, Newberg, OR (US); Dennis Alan Colt

( * ) Notice: Subject to any disclaimer, the term of this patent is extended or adjusted under 35 U.S.C. 154(b) by 1321 days.

(21) Appl. No.: 11/176,076

(22) Filed: Jul. 7, 2005

(51) Int. Cl.
*H04R 1/20* (2006.01)

(52) U.S. Cl.
CPC ..... *H04R 1/20* (2013.01)

(58) Field of Classification Search
CPC ... H04R 1/02; H04R 1/20; H04R 1/22; H04R 1/26; H04R 1/2826; H04R 1/2849; H04R 5/02
USPC ..... 381/99, 336, 332, 303, 304, 345, 182, 381/386; 181/199, 148, 153
See application file for complete search history.

(56) References Cited

U.S. PATENT DOCUMENTS

| | | | | |
|---|---|---|---|---|
| 3,818,138 | A * | 6/1974 | Sperrazza, Jr. | 381/336 |
| 4,179,585 | A | 12/1979 | Herrenschmidt | |
| 4,200,170 | A | 4/1980 | Williams, Jr. | |
| 4,882,760 | A * | 11/1989 | Yee | 381/386 |
| 5,227,591 | A * | 7/1993 | Tarkkonen | 181/145 |
| 5,847,331 | A | 12/1998 | Vollmer et al. | |
| 5,995,634 | A | 11/1999 | Zwolski | |
| 6,152,257 | A | 11/2000 | Denham | |
| 6,186,269 | B1 | 2/2001 | Vollmer et al. | |
| 2002/0076002 | A1 | 6/2002 | Juszkiewicz et al. | |

* cited by examiner

*Primary Examiner* — Ping Lee

(57) ABSTRACT

A speaker producing total sound immersion by directing the sound in off-horizontal directions, and directing sound in different frequency ranges in different directions. The low range driver, or woofer, is oriented downward, and fitted with a dispersion plate, which deflects the sound along the floor and up into the room. The high range drivers, or tweeters, are oriented upward and set for wide dispersion, so that the high pitched sound is reflected off the ceiling and is more evenly distributed. One midrange driver is set in each side of the speaker box, and the sides are angled, so that the box is in the form of a truncated pyramid. This causes the midrange sound to be reflected off the walls and ceiling of the room. The result is one speaker producing a total sound immersion effect.

2 Claims, 2 Drawing Sheets

NON-HORIZONTAL MULTIDIRECTIONAL COMPOSITE SPEAKER

CROSS REFERENCE TO RELATED APPLICATIONS

This application does not claim the benefit of the filing date of any other application.

STATEMENT REGARDING FEDERALLY SPONSORED RESEARCH OR DEVELOPMENT

None.

REFERENCE TO A "SEQUENCE LISTING," A TABLE, OR A COMPUTER PROGRAM LISTING APPENDIX SUBMITTED ON A COMPACT DISC AND AN INCORPORATION-BY-REFERENCE OF THE MATERIAL ON THE COMPACT DISC (SEE 37 CFR 1.52(E)(5)

Not applicable.

BACKGROUND OF THE INVENTION

Field of the Invention

This invention relates to speakers, which are devices for converting electrical signals into airborne acoustic energy (sound). Most currently available speakers, like the present invention, accomplish this conversion by utilizing one or more devices comprising a conical diaphragm with a solenoid or piezoelectric device situated at the apex of the diaphragm, and oriented along the axis of the cone, so that an electrical impulse applied to the solenoid or piezoelectric device results in a wave of acoustic energy being projected from the diaphragm. This patent refers to such devices as "acoustic drivers," and to rigid structures containing one or more acoustic drivers as "speakers."

There are a wide variety of acoustic drivers available on the market, and many of them are optimized for use in a particular range of audible sound. Many speaker designs incorporate drivers of different designs, each optimized for a particular range, and mount multiple drivers in a single speaker, all facing the same direction. The resulting speaker produces an aggregate acoustic signal that is more faithful to the electronic input than the acoustic signal of a speaker comprising a single acoustic driver of similar quality would be.

There is significant technology involved in the design of speakers. Most existing speakers comprise a cabinet or box and one or more acoustic drivers. Larger speakers are typically intended to be placed in a room as furniture, while smaller speakers are typically intended to be placed on a table or desk. The cabinet or box of a properly designed speaker must avoid undesirable resonance or sympathetic vibration, and should optimally allow some amount of desirable resonance, either of the speaker structure or of the air contained within the structure. There is a class of speakers intended for outdoor use, but this invention does not address this class. The cabinet or box is typically fitted with a cloth or slotted covering, which should protect the drivers from damage, debris and dust to some degree, but not undesirably impede the transmission of acoustic energy. The cabinet or box should be durable and aesthetically pleasing. Resonance properties, coverings, aesthetics and durability are all important, but are not the areas in which the present invention lies. Rather, the present invention is unique in the orientation of the acoustic drivers within the speaker.

This speaker design was developed mostly for the purpose of producing music, typically from pre-recorded signals, as in a home or commercial stereo system, in an enclosed space. One problem with existing speaker types, or systems comprising multiple speakers of existing types in an enclosed space, is that the sound they produce is typically very unevenly distributed throughout the space. The specific purpose of the present invention is to produce a more even distribution of sound than was possible using prior technology.

The most common type of existing speaker is a box or cabinet containing one or more acoustic drivers all oriented in the same direction, which is horizontal when the speaker is in its intended attitude. These designs produce a sound pattern which is cone or fan shaped. Although the angular width of the cone or fan is occasionally the subject of design attention, relatively little attention has been paid to producing alternative sound patterns.

DESCRIPTION OF THE RELATED ART INCLUDING INFORMATION DISCLOSED UNDER 37 CFR 1.97 AND 1.98

There are a wide variety of commercially available speakers, of varying levels of weather-resistance, cost, size, and fidelity. This invention is for indoor, high fidelity speakers, and is competitive with high cost, large size speakers.

The most common speakers in this class are a box or cabinet containing multiple more acoustic drivers optimized for different ranges, typically three, all oriented in the same direction, which is horizontal when the speaker is in its intended attitude. These unidirectional speakers produce a sound pattern which is cone shaped. The design of the speakers themselves takes no account of the space in which they are to be used.

Some pyramidal speaker designs have been proposed which attempt to achieve effects similar to the present invention. One design is disclosed in U.S. Pat. No. 4,179,585 to Herrenschmidt. The Herrenschmidt speaker mounted its drivers on the inclined sides of a pyramidal speaker and was designed to take advantage of the reflective properties of the walls and ceiling of the room in which the speaker was located. Each side of the Herrenschmidt speaker what was equipped with drivers contained, however, a full suite of drivers—that is a high-range, a mid-range and a low-range driver. The Herrenschmidt speaker was simply multiple conventional speakers mounted at an angle to the horizontal and enclosed in a single cabinet.

More recently, U.S. Pat. No. 6,152,257 to Denham discloses a 3-sided pyramidal speaker incorporating an upward-facing high range driver, a downward-facing low range driver, and a single non-horizontal, non-vertical mid-range driver which is to be directed against a wall, so that the listener hears mostly reflected sound from this single source. Since the Denham speaker's mid-range sound comes from a single speaker, it does not produce as much of the sensation of total sound immersion as if the mid-range sound came from multiple directions, as in the present invention. Similarly, the Denham speaker's high-range and low-range drivers are both vertically mounted and fitted with pyramid reflectors which redirect their energy in a horizontal direction. This design uses a non-horizontal configuration to produce a sound which ultimately leaves the speaker in a horizontal direction.

BRIEF SUMMARY OF THE INVENTION

The present invention overcomes problems in the prior art by creating a sound pattern which is less variable throughout the volume of a closed room than is possible using existing speaker designs. In its preferred embodiment the present invention is a cabinet in the shape of a truncated pyramid comprising: (1) a square top; (2) four trapezoidal sides, mounted non-vertically, with their longest side at the bottom; (3) a square bottom panel; (4) four spacers placed at the corners of the bottom panel separating the bottom panel from a deflector plate; (5) a deflector plate, described below; (6) four legs placed at the corners of the deflector plate separating the deflector place from the floor; (7) two high range acoustic drivers, mounted in the top, facing up; (8) four mid-range acoustic drivers, one mounted on each side panel, facing out and up; (9) one low range driver, mounted in the bottom panel, facing down toward the deflector plate; (10) wiring and electronic means for disaggregating the input electrical signal and distributing it to the appropriate acoustic drivers; and (11) a covering.

This invention produces total sound immersion by producing sound which comes out of the speaker in directions other than horizontal and by facing drivers for different ranges in different directions. This utilizes the acoustic properties of the room in which it is placed, deflecting sound off of the walls, ceiling, and floor. The overall effect is total sound immersion.

DETAILED DESCRIPTION OF THE INVENTION

Figure 1:
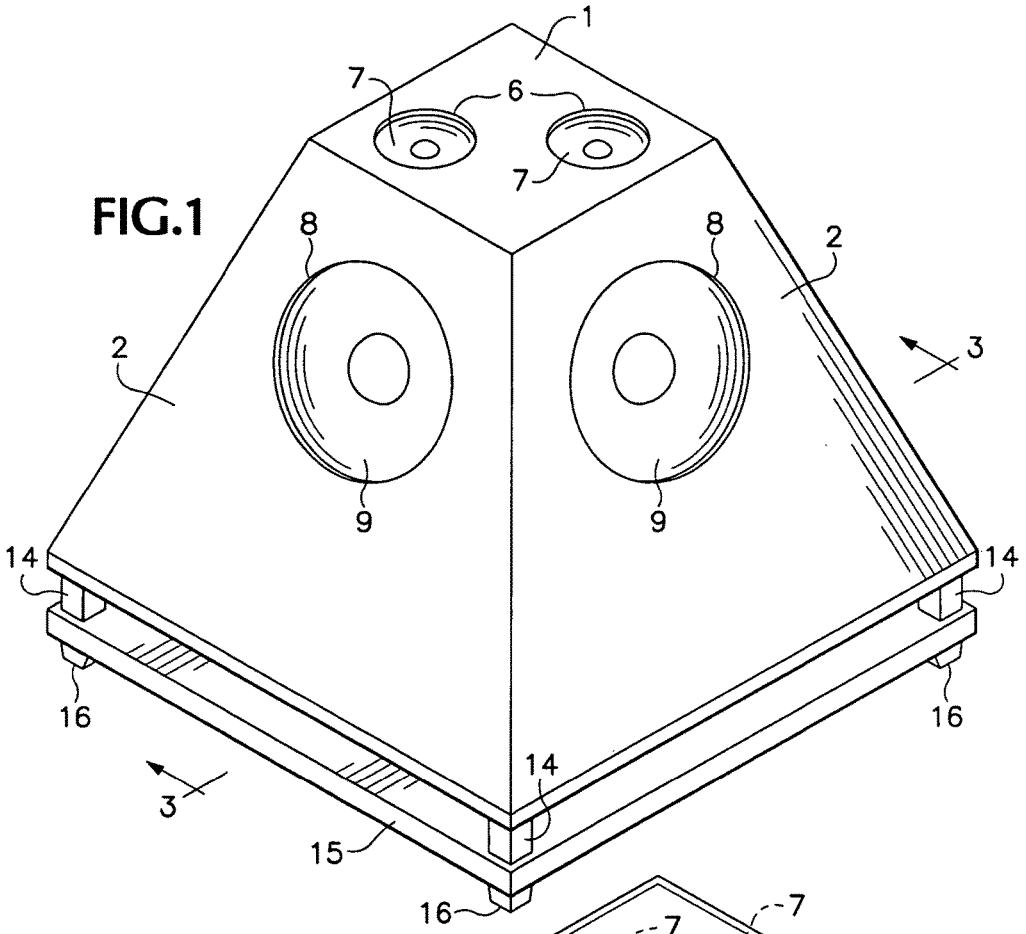
FIG. 1 is a perspective view of the speaker, with the cover removed to show placement of the drivers.
Figure 2:
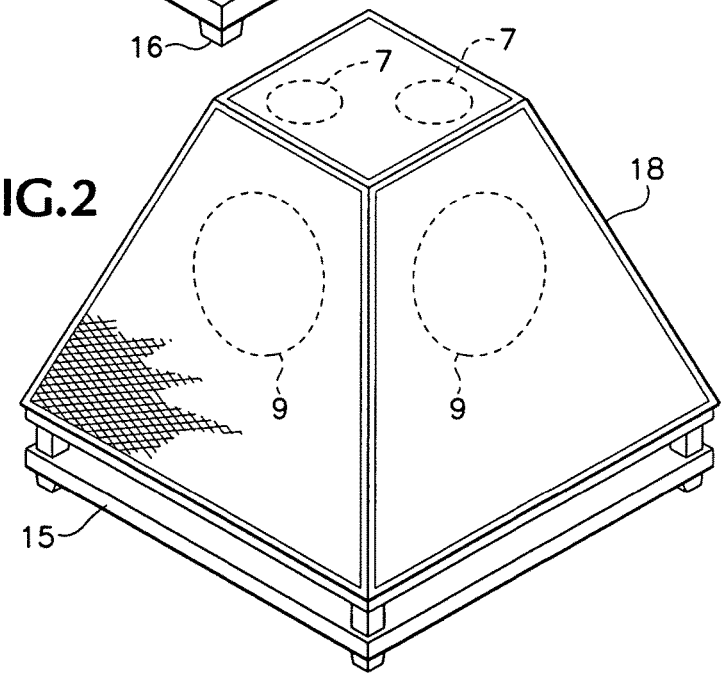
FIG. 2 is a perspective view of the speaker, including the cover.

Referring to FIG. 1, in the preferred embodiment the basic speaker structure consists of a truncated pyramid, which has a total of six flat sides each consisting of a single panel. The sides are angled at 70 degrees off horizontal. Suitable material for the panels would include medium density fiberboard, such as MDF panel sold by Louisiana Pacific of Nashville Tenn. The top panel [1] fiberboard should be from 1.27 cm to 2.86 cm (0.5 inch to 1.125 inch) thick. The side panels [2] and bottom panel [3] fiberboard should be from 1.91 cm to 2.86 cm (0.75 inch to 1.125 inch) thick, or should be composed of two sheets, each 1.27 cm (0.5 inch) thick. Each panel [1], [2] and [3] should be lined on the inside with sound absorbing material [4] a minimum of 1.27 cm (0.5 inch) thick. Suitable sound absorbing material would include acoustic foam such as Sonic Barrier sold by Parts Express Company of Springboro Ohio. In the preferred embodiment, the panels are joined using both glue and either finishing nails or wood screws. Suitable finishing nails include 16 gauge and 18 gauge nails. Suitable wood screws include 3.82 cm (1.5 inch) screws. Liberal use of glue should be made on the interior side of the panel joints for strength and to ensure an air tight seal.

In the preferred embodiment, the top panel [1] has holes [6] for two high range drivers [7]. Each side panel [2] has a hole [8] for one midrange driver [9]. The bottom panel has a hole [10] for one low range driver [11], an access terminal [12] for input, and two ports for venting [13], each 5.09 cm (2 inches) in diameter. Alternatively, one port for venting in the range of 7.64 cm to 10.19 cm (3 to 4 inches) in diameter may be substituted for the two smaller ports [13] in the bottom. As a further alternative, venting can be achieved from the sides.

In the preferred embodiment, the truncated pyramid resting on the bottom panel [3] is supported by four spacers [14], each 10.19 cm (4 inches) long, which rest in turn on the deflector plate [15]. The deflector plate [15] is in turn supported by four legs [16], each 3.82 cm (1.5 inch) long. Suitable material for the spacers [14] and legs [16] includes hardwood lumber with a cross section of 3.82 cm by 3.82 cm (1.5 inch by 1.5 inch).

Figure 3:
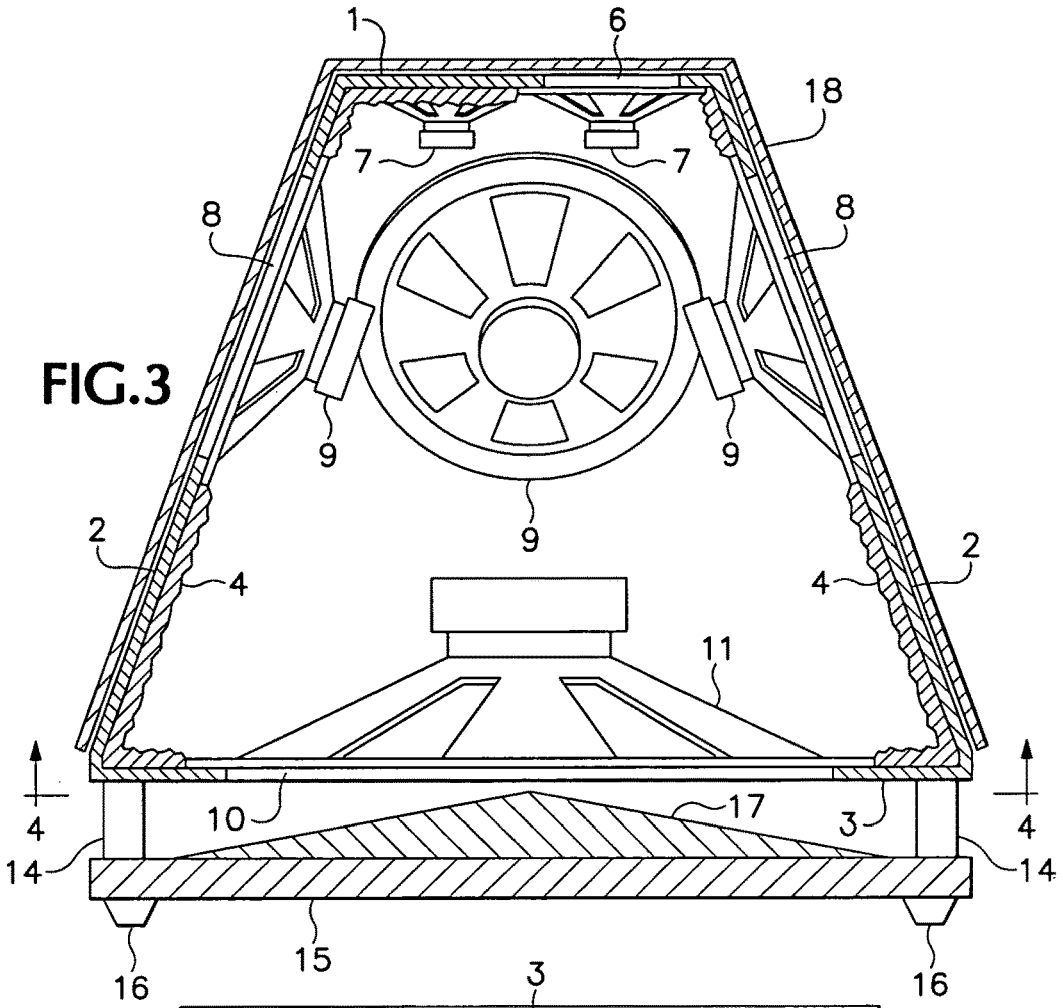
FIG. 3 is a cross-section of the speaker.
Figure 4:
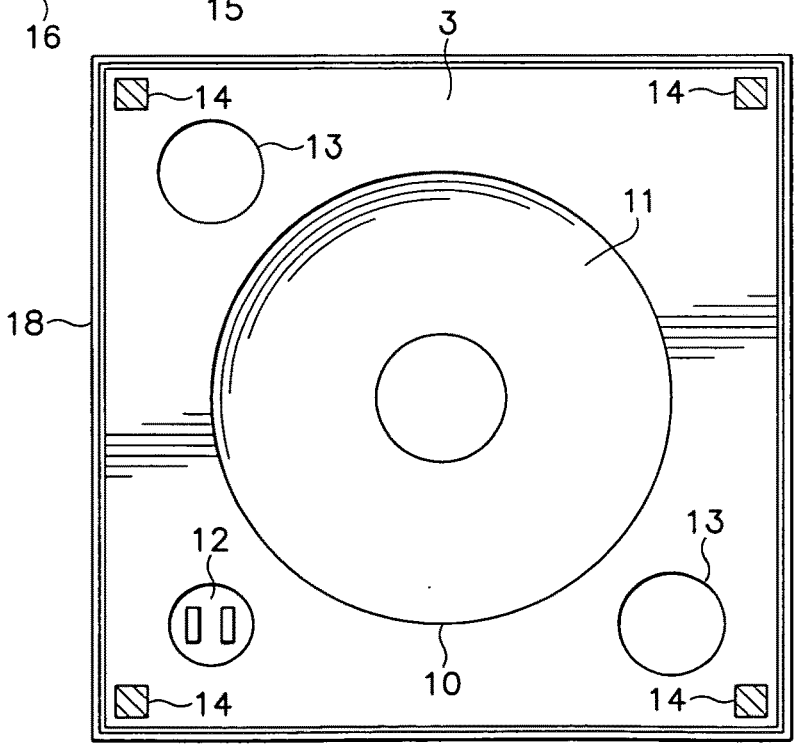
FIG. 4 shows the bottom of the speaker pyramid.

The deflector plate [15] has the same overall horizontal dimensions as the bottom panel [3]. The deflector plate may be built on a base of 1.91 cm (0.75 inch) thick medium density fiberboard, of the same type which comprises the panels above it. Referring to FIG. 3, one embodiment of the deflector plate has mounted on this base a shallow pyramid reflector [17] with a height of 7.64 cm (3 inches). An improved deflector would include wedge shaped uplifts at the perimeter, with the narrow point facing inward, forming an angle of between 30 degrees and 55 degrees and a maximum height at the outer perimeter of 3.82 cm (1.5 inch). An optimal deflector plate [15] would have mounted on this base a reflector which is cone shaped, with each side of the cone being curved in the vertical direction, concave upwards, such that the maximum height is 7.64 cm (3 inches), a minimum height is reached at some middling radius, and the height at the edge of the cone is 3.82 cm (1.5 inch). Suitable material for a pyramidal or conical reflector would include medium density fiberboard of the same type which comprises the panels, or composites. Alternately, the deflector plate may be made of molded plastic.

Each driver [7], [9], and [11] is installed with a rubber or foam air tight gasket. Drivers [7], [9], and [11] may be attached to the panels using 2.55 cm (1 inch) coarse threaded wood screws, using four screws for high range drivers [7] and midrange drivers [9], and eight screws for the low range driver [11]. Alternatively, drivers [7], [9], and [11] may be attached to the panels using rivets. Suitable high range drivers [7] include TB shielded neodymium dome tweeters, by Acoustic Tech. of San Francisco Calif. Suitable midrange drivers [9] include Pyle Pro PDMR sold by Redef Direct of Brooklyn N.Y. Suitable low range drivers [11] include Eminence Magnum series sold by Eminence Company of Eminence Ky. In the preferred embodiment, the high range drivers [7] are set for wide angle, and the midrange drivers [9] are of sealed back type, which makes it unnecessary to create baffles or sealed compartments within the speaker.

In the preferred embodiment, the speaker has an input terminal that is connected to a cross-over board that disaggregates the input into high range, midrange and low range components. Suitable crossover boards include pxb3-5ko 3-way crossover boards sold by Eminence Company of Eminence Ky. The high range output of the crossover board is connected in parallel to two high range drivers [7]. The midrange output of the crossover board is connected to the four midrange drivers [9] using two parallel circuits, each circuit comprising two drivers arranged in series. The low range output of the crossover board is connected to a single low range driver [11]. Suitable wire for the connections includes wire sold by Noble 16 gauge X-Link primary wire sold by Noble Wire & Terminal Corp. of Springfield, Oreg. The wires connecting the drivers to the crossover board should be of uniform length within each driver class.

Referring to FIG. 3, the entire structure above is covered by a cover [18]. The cover [18] is in the shape of a truncated pyramid and is composed of a frame covered with fabric. The frame may be constructed of hardwood lumber with a cross section of 1.91 cm by 3.82 cm (0.75 inch by 1.5 inch). Alternatively, the frame may be of molded plastic. The frame should be constructed so that its interior height is 2.55 cm (1 inch) more than the height of the structure. The frame should be constructed so that its interior horizontal dimensions are 0.64 cm to 0.98 cm (0.25 inch to 0.385 inch) larger than the exterior horizontal dimensions of the structure. Suitable fabric includes Grille Cloth sold by OEM Co. of Sparks Nev. The fabric may be sewn like a sock and then stretched over the frame. A strip of fabric may be glued to the frame to secure a snug fit for the cover.

We claim:

1. A speaker assembly comprising:

a. a multiplicity of acoustic drivers, divided into three ranges, high, mid-range, and low, each range being designated for response in a particular range of acoustic frequencies;

b. means for selectively disaggregating and distributing an input signal so that the drivers in each range receive and project the components of the signal in their designated range; and c. a single rigid structure, shaped as a truncated pyramid, to which all of the drivers are attached, such that:

i) one or more high range drivers, placed at the top of the pyramid, are oriented in a straight up, vertical, direction and no other high range drivers besides said one or more high range drivers are included in the assembly;

ii) the assembly includes four mid-range drivers, and all such drivers are elevated at a uniform angle between 70 degrees and 72 degrees off the horizontal plane, said four mid-range drivers are evenly distributed over a horizontal arc of 360 degrees; and iii) the assembly includes one or more low range drivers oriented in a straight down, vertical direction, fitted with a dispersion plate redirecting the acoustic energy of the drivers;

where one or more ports are arranged, next to said one or more low range drivers and parallel to the directional axis of said one or more low range drivers, for venting;

wherein the dispersion plate fitted to the one or more low range drivers has a surface which is curved in a vertical direction, such that a substantial part of the acoustic energy produced by the one or more low range driver is redirected in a pattern having a wide vertical distribution.

2. The speaker assembly of claim 1, wherein the one or more high range drivers are arranged to project in a dispersed, rather than a tightly focused, pattern.

* * * * *